United States Patent [19]

Doyle et al.

[11] 4,171,135

[45] Oct. 16, 1979

[54] CHANCE BASED SUBMARINE HUNTING GAME

[76] Inventors: Holly T. Doyle; Robert O. Doyle, both of 77 Huron Ave., Cambridge, Mass. 02138; Wendl Thomis, 55 Dinsmore Ave., Framingham, Mass. 01701

[21] Appl. No.: 877,766

[22] Filed: Feb. 14, 1978

[51] Int. Cl.[2] ..... A63F 9/02

[52] U.S. Cl. ..... 273/237; 273/101.2

[58] Field of Search ..... 273/85 G, 101.2, 237, 273/94, DIG. 28, 138 A, 139; 340/323 R, 723-725; 364/200 MS File, 900 MS File; 35/11 A

[56] References Cited

U.S. PATENT DOCUMENTS

| | | | |
|---|---|---|---|
| 3,770,269 | 11/1973 | Elder | 273/138 A |
| 3,809,395 | 5/1974 | Allison | 273/101.2 |
| 3,825,255 | 7/1974 | Kennard et al. | 273/139 X |
| 4,026,555 | 5/1977 | Kirschner et al. | 273/85 G |
| 4,053,740 | 11/1977 | Rosenthal | 273/85 G X |
| 4,093,223 | 6/1978 | Wilke et al. | 273/94 |
| 4,129,883 | 12/1978 | Stubben | 273/DIG. 28 |

OTHER PUBLICATIONS

*101 Basic Computer Games,* Digital Equipment Corp., Mar. 1975, pp. 115-117, 124, 125, 156, 157, 165, 166, 201-204, 207-211.

*Primary Examiner*—Vance Y. Hum

*Attorney, Agent, or Firm*—Kenway & Jenney

[57] ABSTRACT

Game apparatus comprises a control and display console, and a board marked to represent a plurality of ship and submarine positions. The console provides game initiate elements providing a game initiate signal, display light, and player data input switches for input of signals by the player including challenge signals. The apparatus has a randomness source, data storage registers, and submarine data write circuitry responsive to the game initiate signal and to the randomness source for writing initial covert data into the data storage registers. The apparatus further has a range clue comparator responsive to the stored covert data and to the input data signals for outputting clue signals partially representative of the stored covert data for display on the display light, and a challenge comparator responsive to the stored covert data and to the player input signals including the challenge signals for outputting a challenge outcome indicating signal for display.

12 Claims, 4 Drawing Figures

CHANCE BASED SUBMARINE HUNTING GAME

This invention relates to game apparatus. More particularly, it relates to a game played by one or more players, in which an apparatus is employed to generate partially disclosed conditions of play.

Since inexpensive and compact electronic logic circuitry has become available, many games have been designed to employ such circuitry. In general, such games have been of three general types. The first type is a game played on a television screen, in which a paddle and ball game (such as tennis) is simulated for play between two players. Such games are disclosed, for example, in U.S. Pat. No. 3,659,285 (Baer). A second type of game employing electronic circuitry is a game in which the logic functions as an equal opponent to the human player, simulating the play of a second human player; an example of such a game is electronic chess or tick tack toe. Electronic card games, such as the blackjack game of U.S. Pat. No. 3,796,433 (Fraley) also includes electronic means simulating the human dealer and player. A third type of game is one in which the electronic circuitry scores or referees a contest between human players, for example, determining which player first pushes a button or accomplishes a task.

The apparatus of the present invention provides a different type of game, in which the apparatus plays a role different from that of the human players, and generates conditions according to which the players make their moves. This type of game may be called a "hidden player" game, in that not all data relating to the conditions of play are disclosed to the human players.

According to the invention, the apparatus comprises a control and display console having player actuated game initiate means providing a game initiate signal, numerical and directional display light means, and player actuated player data input switches for the input of player more signals comprising a player turn initiate signal, a range clue request signal, signals representing player ship course and speed data indicating a move of player's ship to a subsequent play ship position, challenge signals representing torpedo aim data, and a torpedo fire signal.

The game apparatus further comprises a randomness source, data storage registers for storing player ship data and submarine data, the player sata input switches being connected thereto for writing data into the storage registers, and display lights control means connected to the display light means for control thereof, and connected to the data storage registers for output of data stored therein for display on the display light means. Further, the apparatus comprises submarine data write means responsive to the game initiate signal and to the randomness source for writing into the data storage registers initial covert submarine data representing initial submarine postion, course, and depth data; adder means responsive to the input player move signals and to the stored covert submarine data for updating the covert submarine position data by a constant increment and for storing the updated covert submarine data in the data storage registers; and range clue comparator means responsive to the input player move signals and to the stored covert submarine data and stored player data for providing a range clue output signal representative of distance between the player ship position and the submarine covert position.

The display lights control means is responsive to a range clue output signal representative of a particular minimum distance to control the display light means to indicate an option to input the torpedo aim data signals and a torpedo fire signal. The game apparatus further has challenge comparator means responsive to the stored covert data and stored player data and to the input of the torpedo aim data signals and fire signal for providing one of a plurality of challenge outcome signals comprising a clue output signal representing a non-correspondence between the torpedo aim data and the stored updated submarine covert data, and a win output signal representing correspondence between the input torpedo aim data and the stored updated submarine covert data. The challenge comparator means outputs one of these challenge outcome signals to the display lights control block to control the display light means for display representing the signal.

In preferred embodiments, the apparatus further comprises a board having indicia representing a plurality of positions, including at least one player ship initial position, a plurality of possible subsequent player ship positions, and a plurality of possible submarine positions, the initial submarine position being one of the possible submarine positions represented on the board. The range clue output signal is representative of distance on the board between the player ship position and the submarine covert position. The board is markable by a player for recording successive player positions and successive clue data during a game.

In addition, the apparatus preferably has collision comparator means responsive to the input player move signals corresponding to a first player and to stored signals representative of player ship positions corresponding to the first player and at least one further player, for providing a collision condition output signal representing a position coincidence between the first player ship and the further player ship, and has replacement data write means responsive to the collision condition output signal and to the randomness source for writing to the storage registers replacement data representative of a replacement position and course of the first player ship. The display lights control means is responsive to the collision condition output signal to control the display light means to provide a display representative of the collision condition, and the data storage registers are responsive to a recall signal (input through a recall switch on the control console) to output the replacement position and course data to the display lights control means.

Preferably, the torpedo aim data signals include direction and depth data signals and a torpedo fire signal, and the challenge comparator means is responsive to the stored covert data and to the input of the torpedo aim data signals for providing one of three challenge outcome signals comprising: a direction clue output signal representing a difference between the torpedo aim data and the true direction on the board from the latest player ship position to the updated submarine covert position; a depth clue output signal representing a difference between the submarine covert depth and the input depth data; and a win output signal representing correspondence between the input torpedo aim data and the stored covert data. The challenge comparator means outputs the one challenge outcome signal to the display lights control block to control the display light means for display representing the signal.

Other objects, features and advantages will appear from the following description of a preferred embodiment of the invention, taken together with the attached drawings thereof, in which.

Figure 1:
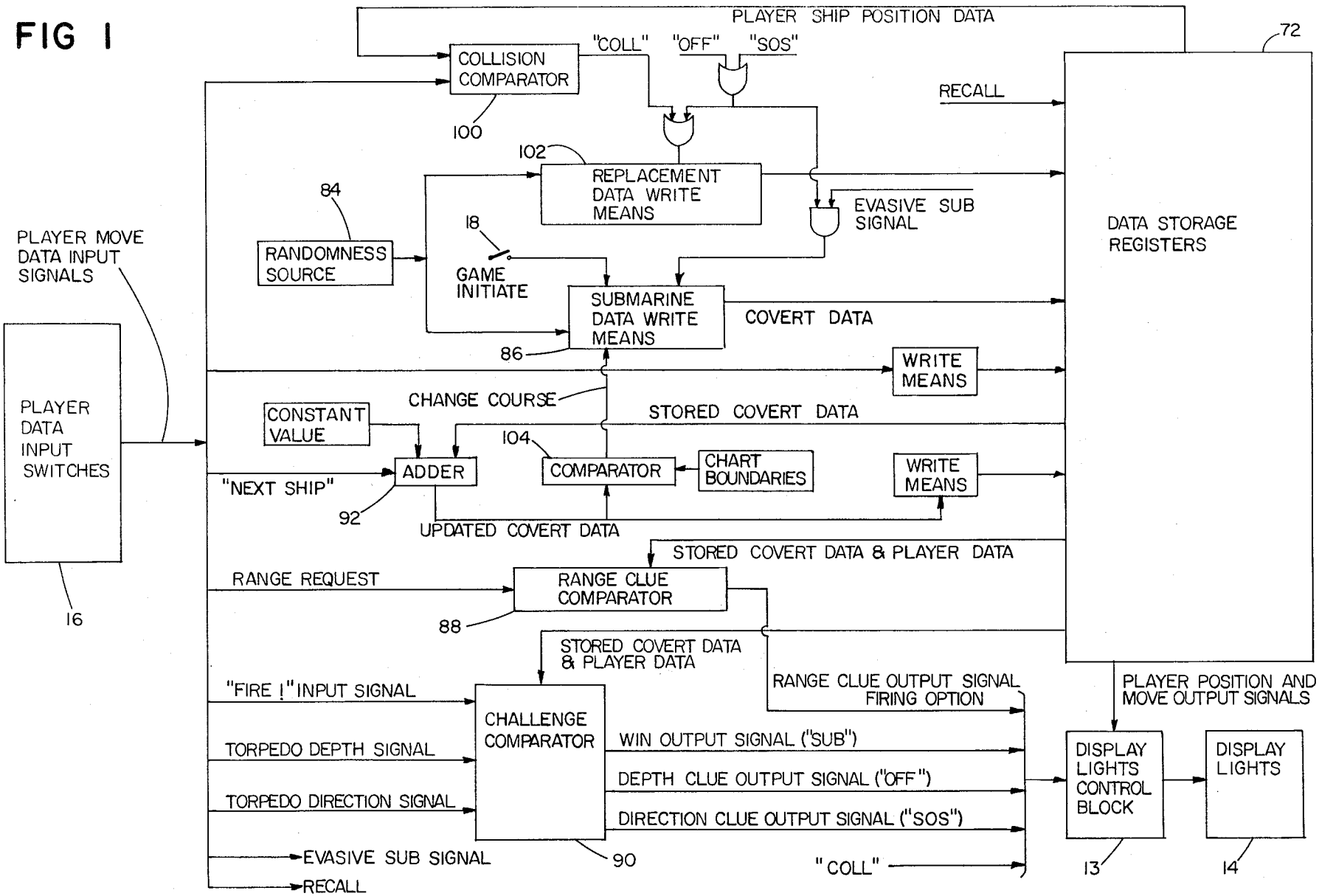
FIG. 1 is a schematic showing of the game apparatus according to the invention.
Figure 2:
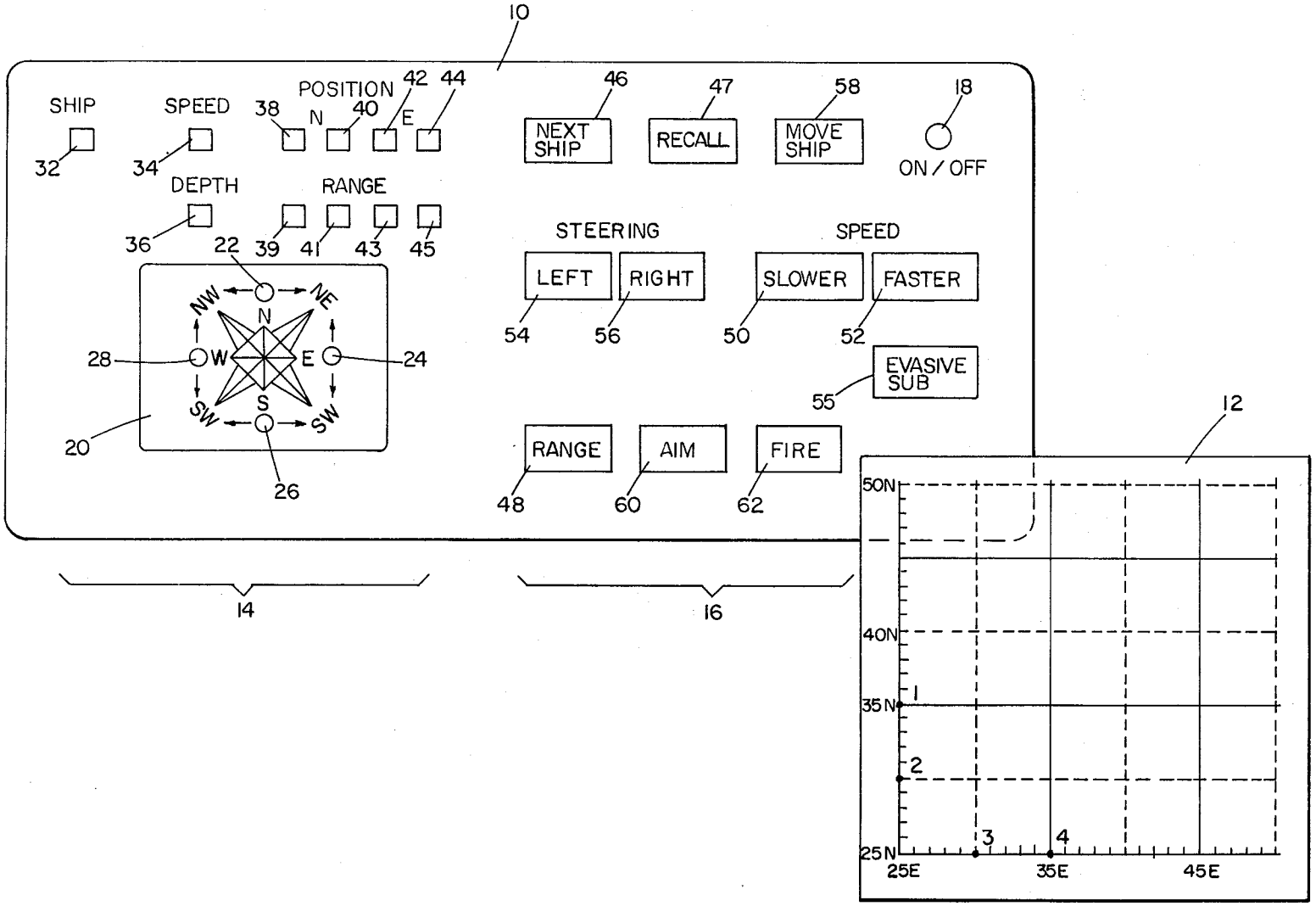
FIG. 2 shows in more detail the control and display console and the board of game apparatus according to a preferred embodiment of the invention.

Referring now to the figures, and particularly to FIGS. 1 and 2, the apparatus of the invention is shown schematically, and comprises a control and display console 10 (FIG. 2) providing a game initiate (ON/OFF) switch 18; when switch 18 is closed a game initiate signal is generated. Switch 18 is connected to a battery or other power source. Display lights generally designated 14 are provided for the display of clues and other data; player data input switches generally designated 16 are provided for the input of player data signals.

A "chart" or board 12 is provided, representing schematically the portion of the ocean where the hunt takes place. The board 12 is provided with boundary indicia, directional coordinates and distance indicia and other indicia representing the various positions at which the target or a player's ship may be located in the course of the game. The players mark on this chart their positions at successive turns, as well as estimates of the target's position based on clues obtained in play, as will be described. The smallest divisions of the chart are not shown in FIG. 2, for clarity.

Briefly, the game apparatus further comprises a randomness source 84 (FIG. 1), such as a random number table, and data storage registers 72. The game apparatus further comprises submarine data write means 86, which in response to the game initiate signal generated when switch 18 is closed and to an input from the randomness source 84 generates an output signal representative of initial covert data, which is written into data storage registers 72.

The apparatus further includes range clue comparator 88, which compares stored covert data with stored player position data, to generate a range clue output signal representative of the result of the comparison, which is input to display lights control block 13 to control the display lights 14. Preferably, the range clue comparator responds to the input of player move signals including the range clue request signal from switch 48.

The apparatus also comprises a challenge comparator 90, which responds to the input of challenge signals from switches 16 and to stored player data and covert data from registers 72 to output challenge outcome indicating signals to control block 13 to control the display lights 14, as will be described in more detail.

The apparatus also provides an adder 92, which at each player's turn (indicated by the signal from "Next Ship" switch 46) updates the stored covert data by a constant increment and stores the new covert data in storage registers 72. Alternatively, such updating can be at fixed or randomly determined time intervals.

More in detail, the game that is played with the apparatus of FIGS. 1 and 2 is a target hunting game in which human players, who move "ships" around on an "ocean", attempt to locate and sink a hidden "submarine".

The console 10 includes an array of display lights 14 and player data input switches 16 comprising a momentary pushbutton array. The display lights 14 include four directional lights 22, 24, 26 and 28, illuminating the points of a compass rose 20. North, east, south and west directions are indicated by the illumination of single lights; northeast, southeast, southwest and northwest directions are indicated by combinations of appropriate lights. No other player courses are possible.

Above the compass rose appears an array of lights comprising digital indicators which indicate the identification number of the ship currently in play (indicator 32); the speed of the ship at indicator 34; and the position of the ship in north and east coordinates in indicators 38 through 44.

During the aim and fire operation, to be explained, depth indicator 36 displays sequentially the numbers 1, 2 and 3. The player must guess which number represents the actual covert depth of the submarine.

Figure 3:
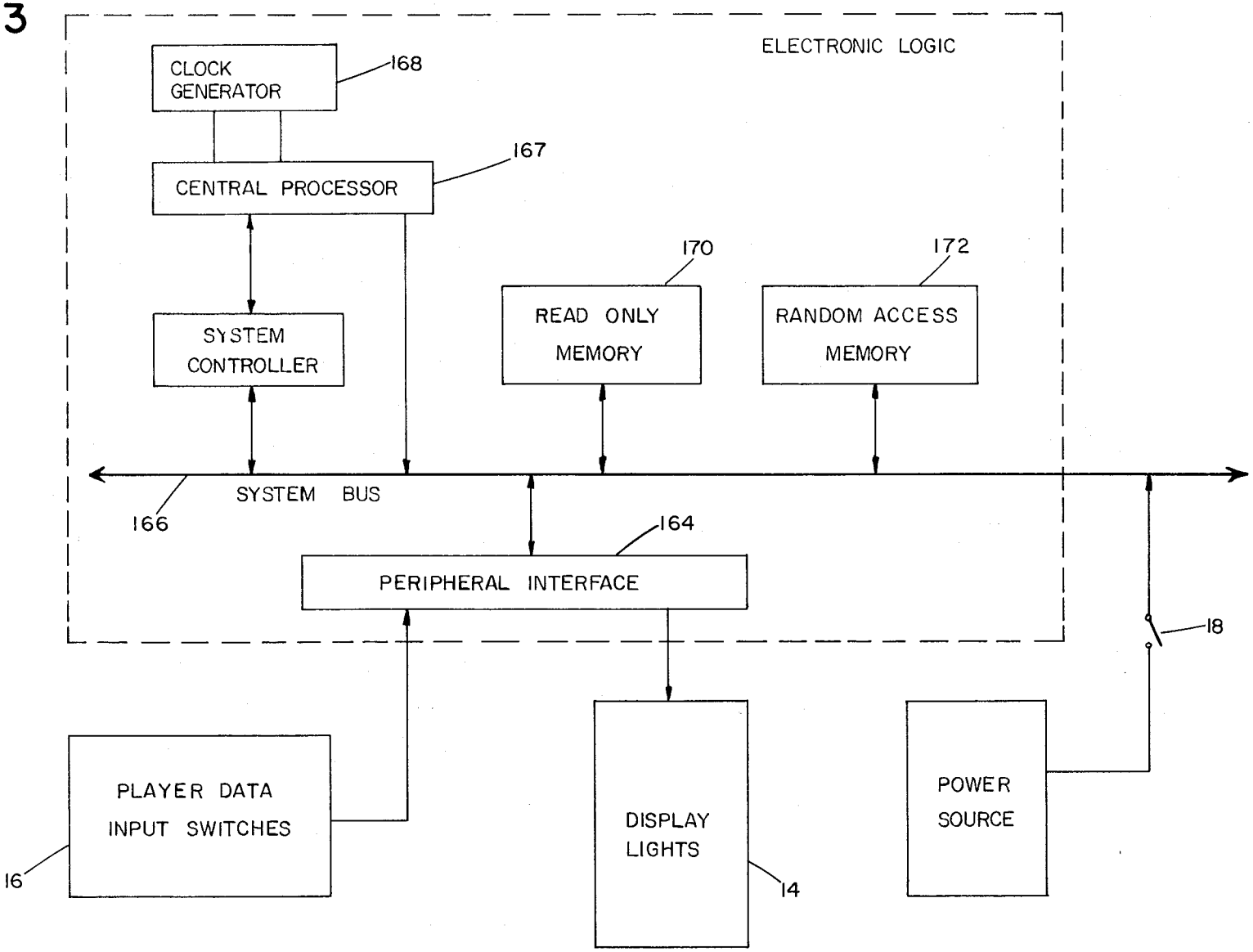
FIG. 3 shows schematically particular electronic logic means including a central processor unit and other elements used to provide a particular embodiment of the invention.
Figure 4:
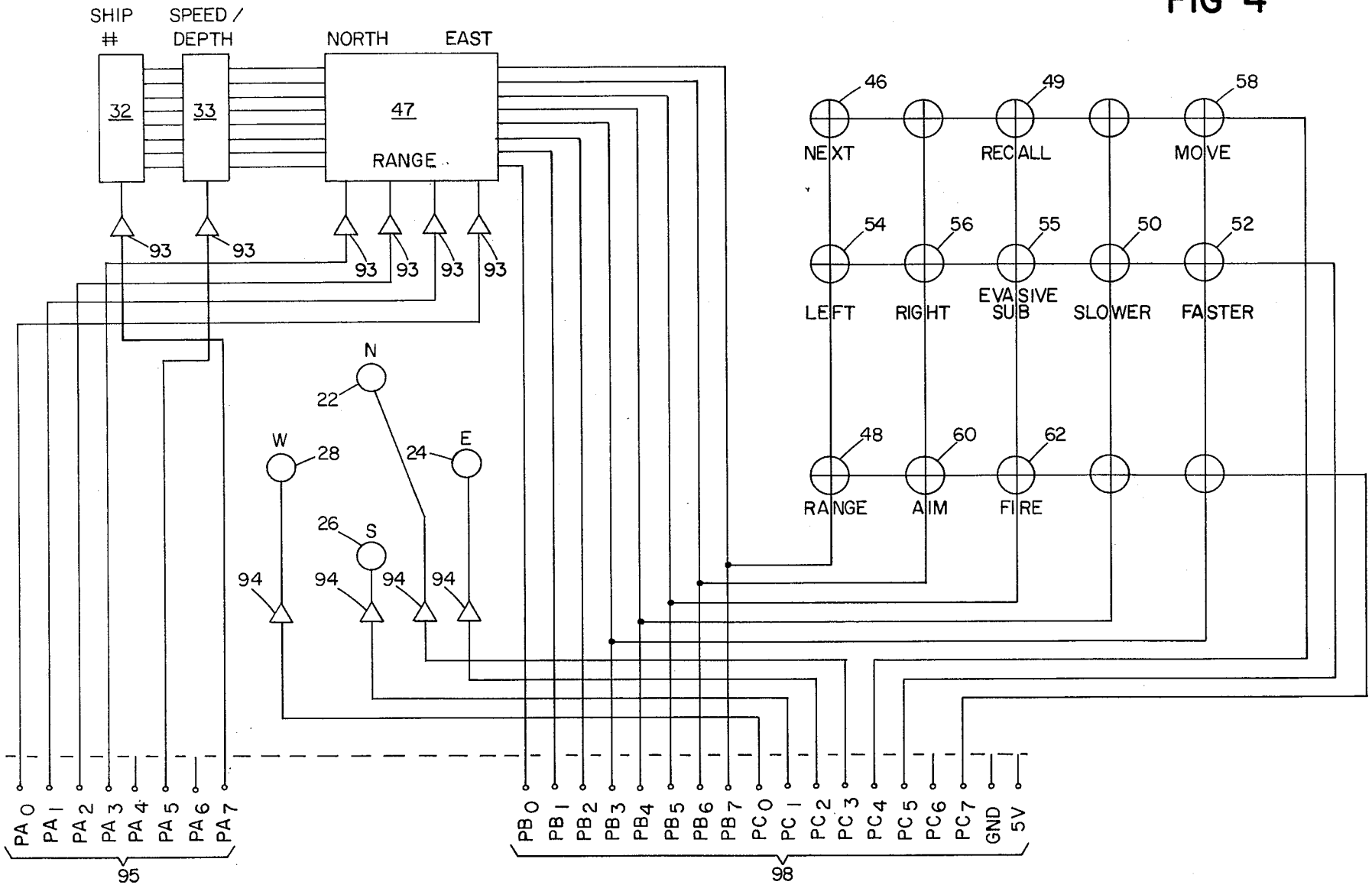
FIG. 4 is a schematic showing of connections between the control and display console of FIG. 2 and the remaining parts of the apparatus.

Appropriate connections to interface the particular display lights 14 and input switches 16 of FIG. 2 with the remainder of the game apparatus are shown schematically in FIG. 4. In a commercial embodiment, for reasons of economy, speed and depth are shown (at different times) on a single display digit. Therefore, the digital indicators 34 (speed) and 36 (depth) of FIG. 2 correspond to the single indicator 33 of FIG. 4. Similarly the numeric indicators 38 through 45 of FIG. 3 correspond to four numeric indicators shown together at 47 of FIG. 4; these four indicators at different times display position and clues. The six numeric display indicators are calculator-type seven-segment numeric display digits, made by Texas Instruments, #392-2. These digits are driven through digit drivers 93 (TTL buffers) and are connected to the six input leads 95. The individual segments of each of the seven-segment display digits are driven through the seven-segment drive lines 96.

The four compass lights 22, 24, 26 and 28 are light-emitting diodes (Texas Instruments #TIL 220) and are driven through LED drivers (TTL buffers) 94.

The input switches 16, as shown in FIG. 2, are the inputs to a conventional momentary pushbutton X-Y matrix keyboard. The compass lights, segment drive lines, and pushbutton inputs are connected to the 18 input leads 98.

The game begins when switch 18 is closed. In response, submarine data write block 86, using the output of randomness source 84, writes the initial covert data into data storage registers 72. The covert submarine data comprises a randomly selected initial position, within the limits shown on chart 12, a depth randomly chosen from three possible values (1, 2 and 3), and a course randomly chosen from the eight possible values indicated on compass rose 20. The speed is a constant value, not randomly selected. New covert data is selected whenever switch 18 is operated.

In the particular embodiment here described, up to four players may play. Each player's "ship" is assigned an identification number (1 to 4). By convention, ship 1 begins every game at the location on the coordinates of chart 12 indicated by the numeral "1"; ship 2 begins at the location identified by the numeral "2", and so on.

These initial ship positions are stored in storage registers 72 when the game is initiated. In addition, each ship begins every game with a pre-assigned course and speed, also stored in storage registers 72.

When the game begins, the first ship's initial position, speed and course are output from registers 72 to control block 13 to control display lights 14. Before moving, the first player can request a range clue by closing "RANGE" switch 48, and in response to the signal from switch 48, clue comparator 88 compares the player's ship position (stored in registers 72) and the covert submarine position (also stored in registers 72) to generate a range clue output signal, representative of the result of the comparison. The range clue output signal is input to control block 13 to cause indicators 41 and 43 to display the "clue data", or present range of the player's ship to the submarine. This range is related to the actual position of the submarine, but does not disclose the actual position, depth or course of the submarine.

The first player moves his ship, based on his judgment of the clue data, and indicates the selected speed and direction of his move through player input data switches 16. Signals representative of the player move are input to storage registers 72.

Speeds of up to nine (small) squares (on chart 12) per move are permitted. The player changes the speed of his ship by repeatedly closing one of the "faster" or "slower" switches 50 and 52, each actuation of the switch producing an input signal representative of a change of one square per move in the speed. The new speed is stored in registers 72 and is displayed at indicator 34. The player changes the course of his ship by repeatedly closing one of the "left" or "right" switches 54 and 56 are required; each actuation of the switch shifts the course of the ship through one increment (i.e. from north to northeast). The new course is stored in registers 72 and is displayed on the lights of the compass rose 20.

When the player has input through input switches 16 all the elements of his selected move, and has verified from the display 14 that he has input the move he intends to make, he closes the "move ship" switch 58. The input player move data updates the previously stored position, course and speed of the appropriate ship in data storage registers 72.

Referring again to FIG. 2, the next player initiates his turn by closing the "next ship" switch 46. (The "next ship" or turn initiate signal from switch 46 and the range request signal from switch 48 are considered to be part of the player move data signals). In response to the signal from switch 46, adder 92 updates the covert submarine position (stored in registers 72) by a constant increment.

The resulting updated position is compared by comparator 104 with the chart boundaries, and if the submarine's move has brought it to the edge of the chart, comparator 104 outputs a "change course" signal to submarine data write means block 86. In response, block 86, using the output of randomness source 84, writes a new course into storage registers 72; the new course is randomly selected among the possible courses that will keep the submarine within the chart boundaries at its next move.

Further in response to the "next ship" input signal, storage registers 72 send output signals representative of the ship identification number, the present position of that ship, and its present course and speed, to control block 13. Control block 13 controls display lights 14 to display at indicator 32 the ship identification number, the present position of the ship at indicators 38 through 44, and the present speed and course of the ship at indicator 34 and on the lights of compass rose 20.

When the next player closes the "range" switch 48, it provides a range request signal, in response to which clue comparator 88 compares the player's most recent ship position and the updated covert submarine position to generate a range clue output signal, representative of the result of the comparison. The range clue output signal is input to control block 13 to cause indicators 41 and 43 to display the "clue data", or present range of the player's ship to the submarine.

When the next player has input through input switches 16 all the elements of his selected move, and has verified from the display 14 that he has input the move he intends to make, he closes the "move ship" switch 58. The input player move data updates the previously stored position, course and speed of the appropriate ship in data storage registers 72. Players three and four move in their turn to complete a round. Several rounds may be completed before the submarine is within firing range.

When a ship moves to within two (small) squares (on chart 12) of the convert position of the submarine, the ship is permitted to "fire" a torpedo at the submarine. This firing option (or challenge option) is indicated to the player, after the player has moved his ship. Range clue comparator 88, responsive to the updated stored player move signals and to the stored submarine position, outputs a firing option signal to control block 13, which controls the lights of indicator 43 to display the firing range and controls the lights of indicator 45 to display the letter "F", causing both indicators to flash on and off. At the same time, control block 13 causes indicator 36 to display the numbers 1, 2 and 3 one after the other, each for a brief time. This indicates three possible depths at which the torpedo may be fired; to indicate his choice, the player closes the "FIRE" switch 62 at a time when the depth indicated at 36 is the depth the player selects. thus the "FIRE" button inputs torpedo aim depth data.

Before firing, however, the player must aim his torpedo. During the time when a player has the option to fire, as indicated by the flashing on and off of indicators 43 and 45, the lights of compass rose 20 display, instead of the ship's course, the direction in which the torpedo points. This direction may be the same as the ship's course but need not be, and usually, in order to hit the submarine, the torpedo must be aimed away from the ship's course.

The player aims his torpedo by means of the "aim" switch 60; each actuation of switch 60 inputs a signal representative of a change of the torpedo firing direction by one increment (e.g. from south to southeast). When the lights of the compass rose 20 indicate the direction the player has chosen, he waits for the depth he wants to appear at indicator 36 and then closes the "fire" switch 62 to input the torpedo depth data signal to challenge comparator 90.

If the "fire" switch is closed during a time when the depth display (indicator 36) shows the actual covert depth of the submarine, as randomly chosen when the game was initiated (stored in registers 72), and if the torpedo firing direction is correct when compared with the actual direction from player's ship to submarine, challenge comparator 90 outputs a "win" signal to control block 13, which causes the lights of display digits 41, 43 and 45 to display the letters "SUB". The player has sunk the submarine.

It will be apparent that the torpedo depth data signals need not be input in the particular manner here described, but could be provided by actuation of one of three additional dedicated switches on console 10. The method described has the advantages of requiring fewer switches, as well as adding excitement to the game.

If challenge comparator 90 compares the input direction and depth data with the stored covert data and the result of the comparison indicates that the direction was correct but the depth incorrect, comparator 90 outputs a depth clue output signal to control block 13, which causes display indicators 39, 41 and 43 to show the letters "OFF", and causes indicator 45 to show a digit representing the magnitude of the error. For example, if the submarine is actually at depth 3, and the player chooses depth 1, the display indicators 39, 41 and 43 will show the letters "OFF" (which indicates that the game must continue) and indicator 45 will show the digit 2, the difference between the covert depth stored in registers 72 and the value of the depth signal input by the player. The player therefore knows the true covert depth. By shading the display with his hand until the "next ship" switch 46 is closed by the next player, the player can conceal his depth clue for use at his next turn. If the player initially inputs depth 2, he receives the clue that he is "OFF 1", but of course he does not know whether the true depth is 1 or 3.

If the player has fired in an erroneous direction and missed the submarine altogether, comparator 90 outputs a direction clue output signal to block 13, which causes indicators 41, 43 and 45 to show "SOS". This display indicates that the game must continue.

Further complexity is provided in the game by the apparatus of the invention, in the form of three features: the "collision", the "sub fire" and the "evasive sub option" features.

The "collision" feature is called into play when a player inputs signals representing a move that causes his ship to "collide" with the ship of another player. The player's move data input signals from the input switches 16 are input to collision comparator 100 (FIG. 1), which compares the input data (together with the stored previous position of the moving player's ship) with the positions of the other players' ships stored in storage registers 72. When the player's input course is such that his ship "moves" through or to a position already occupied by another ship, the comparator 100 detects this condition and outputs a "Collision" signal ("Coll"). This signal causes the replacement data write block 102, using the signal from the randomness source 84, to write new, randomly selected, position and course data into storage registers 72 for the ship of the player who has just moved.

The "COLL" signal is also input to display lights control block 13, which controls the display lights 14 to display a flashing message "COLL" to alert the players to the collision condition. The offending player may find out his new position by closing the "Recall" switch 47 on console 10, which causes the new position and course to be read out of storage registers 72 to the display lights control block 13, which controls the display lights to display the new position and course.

The "sub fire" feature is activated during the challenge process. When challenge comparator 90 outputs a direction clue output signal ("SOS") or a depth clue signal ("OFF"), this signal is input to replacement data write block 102, which uses the output of randomness source 84 to write new position and course data for the firing ship into data storage registers 72. The player is alerted to the condition by the display of "OFF" or "SOS", as previously described. As in the case of a collision, the player may find out his new position by closing the Recall switch 47 on console 10. This feature may alternatively be provided in response to the depth clue output signal ("OFF") only, or in response to the direction clue signal ("SOS") only, as desired.

The "evasive sub" feature may be provided in the form of an option. An "Evasive Sub" switch 55 is provided on console 10. The players may elect to play in this mode by closing this switch at the beginning of a game or at any time during the game. Switch 55 provides an "evasive sub" play mode signal. During the challenge operation, when challenge comparator 90 produces either a depth clue output signal ("OFF") or a direction clue output signal ("SOS"), indicating that the player's torpedo has missed the submarine, the output signal is anded with the "evasive sub" signal and the resulting signal causes the submarine data write block 86, using the output of randomness source 84, to write new covert submarine data into data storage registers 72. The submarine has changed its course to a new and unknown course. This feature may alternatively be provided in response to either challenge outcome clue only, as desired.

The game apparatus of the invention has been described with reference to FIG. 1, showing logic circuit elements such as registers, write means, adders, and-gates, or-gates, and comparators. Such devices are well known in the art of logic circuits and the choice of particular commercial devices to perform the functions of the claimed means forms no part of the present invention. Likewise, appropriate circuitry to control light-emitting diodes and digital displays is well known and no invention is required to select such circuitry; therefore no details of such circuitry has been given beyond indicating at block 13 the inputs to such control and the appropriate place in the apparatus for such control circuitry, as well as the interfacing connections in FIG. 4.

A particularly compact, inexpensive and reliable commercial embodiment of the game apparatus of the invention may be constructed by using a central processor together with a random access memory and a read-only memory containing suitable instructions. When the instructions are executed by the central processor, the functions of the logic circuit elements disclosed in FIG. 1 are performed. The choice of a particular processor and program for this purpose forms no part of the present invention. However, it has been found that suitable electronic logic means for use in constructing this game are provided by the Intel 8080 System Design Kit (SDK-80), described in the Intel MCS-80 System Design Kit User's Guide (copyright 1976) and the Intel 8080 Microcomputer System Manual (copyright 1975), which explains the programming of the system. The showing in FIG. 3 is adapted from a showing in the User's Guide. The display lights 14 and input switches 16 of FIG. 1 and FIG. 4 are shown connected through a peripheral interface block 164 to the system bus 166. A central processor 167, with a clock generator 168, operates according to a hard-wired program stored in the read-only memory 170. Random access memory 172 serves as the data storage registers 72 of FIG. 1.

A listing of suitable code to be hard-wired in read-only memory 170 is shown below in an appendix by way of example only. The details of the particular program employed are a matter of design choice and form no part of the invention. This code is listed in assembly language, compatible with the 8080 logic described in the manuals referred to above, and may be interpreted by referring to those manuals. The randomness source 84 is not explicitly shown in FIG. 3. According to the hard-wired instructions, the signals from clock 168 are counted by the electronic logic and portions (low-order digits) of the running total of signals are employed as the random numbers when required. The electronic logic unit, operating according to the hard-wired instructions in read-only memory 170, performs the functions of the submarine data write means 86, range clue comparator 88, challenge comparator 90, adder 92 and other circuit elements of FIG. 1.

Referring again to FIG. 4, the interfacing connections at 95 and 98 are labeled to correspond with the labeled connections shown on pages 60 and 61 of the Intel MCS-80 System Design Kit User's Guide, previously referred to.

What is claimed is:

1. Apparatus for a submarine hunting board game playable by at least one player, comprising a control and display console having player actuated game initiate means providing a game initiate signal, numerical and directional display light means, player actuated player data input switches for input of player move signals comprising a player turn initiate signal, a range clue request signal, signals representing player ship course and speed data indicating a move of player's ship to a subsequent player ship positions, signals representing torpedo aim data, and a torpedo fire signal, said game apparatus further comprising a randomness source, data storage registers for storing player ship data and submarine data, said player data input switches being connected thereto for writing data into said storage registers, display lights control means connected to said display light means for control thereof, and connected to said data storage registers for output of data stored therein for display on said display light means, submarine data write means responsive to said game initiate signal and to said randomness source for writing into said data storage registers initial covert submarine data representing initial submarine position adder means responsive to said input player move signals and to said stored covert submarine data for updating said covert submarine position data by a constant increment and for storing said updated covert submarine data in said data storage registers, range clue comparator means responsive to stored said input player move signals and to said stored covert submarine data and stored player data for providing a range clue output signal representative of distance between said player ship position and said submarine covert position, said display lights control means being responsive to a said range clue output signal representive of a particular minimum distance to control said display light means to indicate an option to input said torpedo aim data signals and torpedo fire signal, said game apparatus further having challenge comparator means responsive to said stored covert data and player data and to the input of said torpedo aim data signals for providing one of a plurality of challenge outcome signals comprising a clue output signal representing a non-correspondence between said torpedo aim data and said stored updated submarine covert data, and a win output signal representing correspondence between said input torpedo aim data and said stored updated submarine covert data, said challenge comparator means outputting said one challenge outcome signal to said display lights control block to control said display light means for display representing said signal.

2. The apparatus of claim 1, in which said initial covert submarine data further represents initial course and depth of said submarine, said input torpedo aim data signals include direction and depth signals, and said plurality of challenge outcome signals comprises a direction clue output signal representing a difference between said input torpedo aim direction data and the true direction on said board from said latest player ship position to said updated submarine covert position, a depth clue output signal representing a difference between said submarine covert depth and said input torpedo aim depth data, and a win output signal representing correspondence between said input torpedo aim data and said stored covert data, said challenge comparator means outputting said one challenge outcome signal to said display lights control means to control said display light means for display representing said signal.

3. The apparatus of claim 2, further comprising replacement data write means responsive to said direction clue output signal and said randomness source for writing to said storage registers replacement data representative of a randomly determined replacement position and course of the player ship.

4. The apparatus of claim 2, further comprising replacement data write means responsive to said depth clue output signal and said randomness source for writing to said storage registers replacement data representative of a replacement position and course of the player ship, said replacement position being randomly determined.

5. The apparatus of claim 2, said control and display console further having an evasive target switch, providing a signal representative of an evasive target play mode, said submarine data write means being responsive to said evasive target play mode signal, said depth clue output signal, and said randomness source to write replacement submarine covert data into said storage registers.

6. The apparatus of claim 1, further comprising collision comparator means responsive to said input player move signals corresponding to a first player and to signals representative of stored player ship positions corresponding to said first player and at least one further player, for providing a collision condition output signal representing a position coincidence between said first player ship and said further player ship, and replacement data write means responsive to said collision condition output signal and to said randomness source for writing to said storage registers replacement data representative of a replacement position and course of said first player ship, said display lights control means being responsive to said collision signal to control said display light means to provide a display representative of said collision condition.

7. The apparatus of claim 6, said control and display console further having a recall switch providing a recall signal, said data storage registers being responsive to said recall signal to ouput player position and course data to said display lights control means.

8. The apparatus of claim 1, further comprising a board having indicia representing chart boundaries and a plurality of positions including at least one player ship initial position, a plurality of possible subsequent player ship positions, and a plurality of possible submarine positions, said input player move signals indicating a move of player's ship to one of said possible subsequent player ship positions, and said initial submarine position being one of said possible submarine positions, said range clue output signal being representative of distance on said board between said player ship position and said submarine covert position, said board being markable by a player for recording successive player positions and successive clue data during a game.

9. The apparatus of claim 8, further comprising comparator means for comparing said updated submarine position data with data representative of said chart boundaries, and responsive to a coincidence condition thereof to output a change course signal, said submarine data write means being responsive to said change course signal and to said randomness source to write to said storage registers new submarine course data for maintaining said submarine position within said chart boundaries when next updated by said adder.

10. Apparatus for a submarine hunting game playable by at least one player, comprising a control and display console and a board, said board having indicia representing a plurality of positions, said positions including at least one player ship initial position, a plurality of possible subsequent player ship positions, and a plurality of possible submarine positions, said control and display console having player actuated game initiate means providing a game initiate signal, numerical and directional display light means, player actuated player data input switches for input of player move signals comprising a player turn initiate signal, a recall signal, a range clue request signal, signals representing player ship course and speed data indicating a move of player's ship to one of said possible subsequent player ship positions represented on said board, signals representing torpedo aim data including direction and depth data, and a torpedo fire signal, said game apparatus further comprising a randomness source, data storage registers, said player data input switches being connected thereto for writing data into said storage registers, display lights control means connected to said display light means for control thereof, and connected to said data storage registers for output of data stored therein for display on said display light means, submarine data write means responsive to said game initiate signal and to said randomness source for writing into said data storage registers initial covert submarine data representing initial submarine position, course, and depth data, said initial submarine position being one of said possible submarine positions represented on said board, adder means responsive to said input player move signals and to said stored covert submarine data for updating said covert submarine position data by a constant increment and for storing said updated covert submarine data in said data storage registers, collision comparator means responsive to said input player move signals corresponding to a first player and to stored signals representative of player ship positions corresponding to said first player and at least one further player, for providing a collision condition output signal representing a position coincidence between said first player ship and said further player ship, replacement data write means responsive to said collision condition output signal and to said randomness source for writing to said storage registers replacement data representative of a replacement position and course of said first player ship, said display lights control means being responsive to said collision condition output signal to control said display light means to provide a display representative of said collision condition, and said data storage registers being responsive to said input recall signal to output said replacement position and course data to said display lights control means, range clue comparator means responsive to said input player move signals and to said stored player data and covert submarine data for providing a range clue output signal representative of distance on said board between said player ship position and said submarine covert position, said board being markable by a player for recording successive player positions and successive clue data during a game, said display lights control means being responsive to a said range clue output signal representative of a particular minimum distance to control said display light means to indicate an option to input said torpedo aim data signals including direction and depth data signals and a torpedo fire signal, said game apparatus further having challenge comparator means responsive to said stored covert data and to the input of said torpedo aim data signals for providing one of three challenge outcome signals comprising a direction clue output signal representing a difference between said torpedo aim data and the true direction on said board from said latest player ship position to said updated submarine covert position, a depth clue output signal representing a difference between said submarine covert depth and said input depth data, and a win output signal representing correspondence between said input torpedo aim data and said stored covert data, said challenge comparator means outputting said one challenge outcome signal to said display lights contol means to control said display light means for display representing said signal.

11. The apparatus of claim 10, in which said replacement data write means is further responsive to said randomness source and to at least one of said direction clue output signal and said depth clue output signal for writing to said storage registers replacement data representative of a replacement position and course of the player ship, said replacement position being randomly determined but being one of said possible player ship positions on said board.

12. The apparatus of claim 11, said control and display console further having an evasive target switch, providing a signal representative of an evasive target play mode, said submarine data write means being responsive to said evasive target play mode signal, said depth clue output signal, and said randomness source to write replacement submarine covert data into said storage registers.

* * * * *